US005275627A

United States Patent [19]

Cates et al.

[11] Patent Number: 5,275,627

[45] Date of Patent: * Jan. 4, 1994

[54] PROCESS FOR DYEING OR PRINTING/FLAME RETARDING ARAMIDS

[75] Inventors: Barbara J. Cates; Phillip H. Riggins, both of Greensboro, N.C.; David R. Kelly, Dalton, Ga.

[73] Assignees: Burlington Industries, Inc., Greensboro, N.C.; ProChrome Technologies, Inc., Chattanooga, Tenn.

[ * ] Notice: The portion of the term of this patent subsequent to Jan. 1, 2008 has been disclaimed.

[21] Appl. No.: 834,119

[22] Filed: Feb. 13, 1992

Related U.S. Application Data

[60] Continuation-in-part of Ser. No. 599,498, Oct. 18, 1990, abandoned, Division of Ser. No. 394,334, Aug. 16, 1989, Pat. No. 4,898,596.

[51] Int. Cl.[5] ..... C09B 67/00

[52] U.S. Cl. ..... 8/572; 8/490; 8/542

[58] Field of Search ..... 8/425, 490, 492, 542, 8/572, 574

[56] References Cited

U.S. PATENT DOCUMENTS

| | | | |
|---|---|---|---|
| 4,073,615 | 2/1978 | Lacroix et al. | 8/25 |
| 4,705,523 | 11/1987 | Hussamy | 8/490 |
| 4,705,527 | 11/1987 | Hussamy | 8/490 |
| 4,741,740 | 5/1988 | Davis et al. | 8/490 |
| 4,759,770 | 7/1988 | Cates et al. | 8/490 |
| 4,898,596 | 2/1990 | Riggins et al. | 8/490 |
| 4,981,488 | 1/1991 | Cates et al. | 8/574 |

*Primary Examiner*—Asok Pal
*Assistant Examiner*—P. Achutamurthy
*Attorney, Agent, or Firm*—Nixon & Vanderhye

[57] ABSTRACT

Aramid fabrics treated with N-cyclohexyl-2-pyrrolidone prior to or simultaneously with aqueous print pastes promote fabric printability and produces good coloration. Saturated steam or superheated steam at a temperature of at least 100° C. permeates and fixes the dye inside of the aramid fibers. Print pastes containing N-cyclohexyl-2-pyrrolidone, dye and thickener are also described.

25 Claims, No Drawings

PROCESS FOR DYEING OR PRINTING/FLAME RETARDING ARAMIDS

This is a continuation-in-part of application Ser. No. 07/599,498, filed Oct. 18, 1990, abandoned, which is a divisional of Ser. No. 07/394,334, filed Aug. 16, 1989 now U.S. Pat. No. 4,898,596.

This invention relates to printing aramid fabrics with an aqueous print paste.

BACKGROUND OF THE INVENTION

Aramid fibers are highly resistant to heat decomposition, have inherent flame resistance, and are frequently used in working wear for special environments where flame resistance is required. These and other inherent desirable properties of aramid fibers also create difficulties for fiber processing in other areas; specifically, aramids are difficult to dye.

A process for the continuous or semi-continuous dyeing of and simultaneously improving the flame-resistant properties of poly(m-phenyleneisophthalamide) fibers has been described by Cates et al in U.S. Pat. No. 4,759,770. The process includes the use of a fiber swelling agent solution also containing one or more dyes and a flame retardant, the dye and the flame retardant introduced into the fiber while in the swollen state. Suitable swelling agents are dimethylsulfoxide (DMSO), dimethylacetamide (DMAC) and N-methylpyrrolidone (NMP).

Printing of aramid fabrics using a print paste composed of a polar solvent such as DMSO, DMAC or NMP, a dye, water and a print paste thickener is described in Hussamy, U.S. Pat. No. 4,705,527; these print pastes may also include a flame retardant as in Hussamy U.S. Pat. No. 4,706,523. Aramid fabrics printed in a camouflage pattern have specific application for military use where personnel have the potential to be exposed to fire and flame. Fabrics made of highly crystalline aramid fibers, such as DuPont's Nomex® having high glass transition temperatures are difficult to print. The two Hussamy patents noted above describe procedures for obtaining printed aramid fabrics using polar solvents but the processes require some specialized equipment.

An exhaust process for dyeing or simultaneously dyeing and improving the flame resistance of aramid fibers using N-cyclohexyl-2-pyrrolidone (CHP) as a dye carrier under conditions of elevated temperature and optionally elevated pressure is described in PCT/US88/04074 published as WO 89/06292 on Jul. 13, 1989. Although residual CHP remaining on the fibers or fabric is usually removed from the dyed goods prior to further processing, we have found that residual CHP facilitates printing the thus treated aramid fabric with an aqueous print paste. This observation has suggested the application of CHP prior to printing to aramid fabrics in general, regardless of prior processing if any, as a preparatory treatment to printing.

Unlike the highly polar solvents such as DMSO, DMF and NMP which require about 60% concentration in aqueous solution to maintain their swelling/partial solvency of certain aramid fibers, CHP maintains its ability to permeate such fibers in concentrations of only about 5% in aqueous solutions. The ability to work at lower concentrations limits the damage this organic solvent causes to aramid fabrics as compared with other aprotic solvents.

DESCRIPTION OF THE INVENTION

We have determined that treatment of aramid fabrics with N-cyclohexyl-2-pyrrolidone (CHP), prior to or simultaneously with printing with aqueous print pastes, promotes the printability of aramid fabrics and produces good coloration. CHP acts on aramid fibers as a swelling agent and diffusion promoter for dyes and flame retardants. CHP is very soluble in water up to about 150° F., but at higher temperatures its solubility in water decreases. We believe that CHP, under the conditions described herein, has a high affinity for Nomex® which is time and temperature related—the higher the temperature and longer the exposure time, the more CHP the fiber absorbs. Because of its high boiling point, CHP is quite difficult to remove from the fiber, but it does not require specialized processing equipment to contain or recover a highly polar solvent as used in other procedures. On the other hand, CHP remaining on the fabric may reduce the lightfastness of the dyestuff applied. Substantially complete removal of CHP is desirable to maximize fastness properties.

Print pastes used in the process of this invention are water-based and include one or more suitable dyestuffs, a thickener or thickener system of the type used for print pastes and, where the process dictates, compatible with CHP and, if not already present on the fabric to be printed, CHP in an amount sufficient to facilitate printing of the aramid fabric.

An object of this invention is to overprint a previously dyed base shade Nomex® or Nomex® blended fabric with a military camouflage or decorative pattern.

Described is a process of printing a predetermined pattern on an aramid fabric, specifically a fabric composed primarily of dyeable poly(m-phenyleneisophthalamide) fibers optionally also containing polybenzimidazole fibers, which contains a dye-enhancing-/solubilizing amount of CHP on the fabric. CHP may be applied to the fabric prior to printing, the CHP may be in the print paste itself, or the CHP may be resident on the fabric from previous processing such as exhaust dyeing and flame-retardant treating, as described above. Once applied, the printed fabric is heated to a temperature and for a time sufficient to fix the dye, together with other treatment agents that may be present, onto the fibers. CHP remaining on the fabric is then removed, and additional finishes and treatments may be applied as desired. Fabrics printed by this procedure retain coloration and other properties which remain durable to repeated laundering and retain significant strength approaching that of the untreated fabric.

Print pastes containing CHP are also described. In one embodiment, the print paste of the present invention preferably includes about 2.0 to 4.0 parts thickening agent, 5 or more parts CHP, when present, and the balance water; all parts are by weight. Other print paste adjuvants such as fire retardants, UV absorbers, antistatic agents, water repellants and other finishing and processing aids may also be present in the print paste. A tinctorial amount of at least one compatible dyestuff is, of course, included in the print paste.

The thickening agent used in the process can be any of the conventional thickeners for print pastes usable for printing textile materials such as natural starch, British gum, crystal gum, natural and etherified locust bean gums, carboxymethyl cellulose, gum tragacanth, polyacrylic acid sodium salt and sodium alginate, provided that it is soluble in the polar solvent or mixture of solvents when these are used in the print paste and capable of forming a stable, homogeneous printing paste of appropriate viscosity to be able to be used in practice. In one embodiment of the invention, the thickening agent will be of a polyacrylic acid type having a molecular weight range of 450,000 to 4,000,000, and will be present in an amount sufficient so that the resulting print paste will have viscosity ranging between 5,000–36,000 cps.

Any organic dyestuff capable of dyeing the aramid fibers (as defined herein) may be used. Such dyestuffs may be selected from cationic dyes; anionic dyes, e.g., acid dyes, metalized acid dyes, or direct dyes; solvent dyes; disperse dyes; fiber reactive dyes; vat dyes; and azoic dyes, provided that the dye selected is soluble in the print paste and does not affect the homogenity and stability of the print paste. Combinations of these dyes can also be used in the same print paste provided that they are soluble in the print paste and do not affect the homogenity and stability of the print paste.

Fibers suitable for the process of this invention are known generally as aromatic polyamides or aramids. This class includes a wide variety of polymers as disclosed in U.S. Pat. No. a 4,324,706, the disclosure of which is incorporated by reference. Our experience indicates that not all types of aromatic polyamide fibers can be reproducibly dyed by this process; those fibers that are not affected by the dye diffusion promoter and do not allow the dye to enter the fiber are only surface stained and are not fully dyed. Thus, the fibers amenable to the process of this invention are made from a polymer known chemically as poly(m-phenyleneisophthalamide), i.e., the meta isomer which is the polycondensation product of metaphenylenediamine and isophthalic acid. Below is a listing of fibers now commercially available identified by fiber name (usually trademark) and producer:

| Fiber Name | Producer |
|---|---|
| Nomex | DuPont |
| Apyeil (5207) | Unitika |
| Apyeil-A (6007) | Unitika |
| Cone | Teijin |

Accordingly, as used in the text of this application and in the claims that follow, the expressions "aramid" and "aromatic polyamide fiber", when pertaining to the novel process of this invention, will primarily signify the meta isomer. Blends of poly(m-phenyleneisophthalamide) fibers with other fibers, including fibers of the para isomer (Kevlar ®, DuPont), may be subjected to the dyeing process in which case only the meta isomer fibers will be dyed. Included within the invention are treating the meta isomer aramid fibers blended with other fibers such as Kevlar ® (Nomex ® 455 as used in the examples herein is a 95:5 blend of Nomex ® and Kevlar ®), and polybenzimidazole (PBI) in a ratio of 80% of the meta isomer and 20% of PBI. Blends with other fibers such as FR cotton, FR rayon, nylon, wool and modacrylic are also contemplated.

In addition to the dye(s), inert diluent(s) (usually water), print paste thickener and CHP, when present, the print paste may also contain fire retardant(s), the customary print paste additives and auxiliaries, such as softeners (to improve hand and tensile strength), UV absorbing agents, IR absorbing agents, antistatic agents, water repellants, and the like. Alternatively, these and other treatments may be applied to the fabric as a post-treatment finish after dyeing, heating, washing and drying are completed. Preferably the dyed fabric is water washed and heated to remove residual CHP remaining on the fabric as explained above. Typically, the wash water remains sufficiently clear to indicate good dye fixation. Strength and hand of the dyed fabric are improved by an afterfinish of a softener.

Greige fibers or fabrics that are dyed/printed by the process of this invention (as distinguished from solution-dyed fibers in which a coloring agent is included is the resin solution prior to fiber formation) are free of acetophenone, chlorinated solvents such as perchloroethylene and other toxic solvent residues previously used in the dyeing of such fabrics. The CHP-dyed dibers have a strength retention of at least 80%, preferably 90% of the undyed fibers. This distinguishes products produced by our process from aramids dyed by the conventional processes, using acetophenone as a dye carrier, which retain that solvent tenaciously, and Nomex ® dyed by the STX process in which the fibers retain small amounts of perchloroethylene.

The physical form of the fiber to be dyed/printed is also open to wide variation at the convenience of the user. Most printing operations and equipment are suited to treatment of woven or knit fabrics in the open width.

Color retention of printed goods is unexpectedly good whether CHP is applied prior to, or simultaneously with an aqueous print paste. As an illustration, CHP applied simultaneously with an aqueous print paste (Carbopol thickener and acid dye) produced in excess of 60% fixation after scouring in detergent at the boil when the dye was fixed by autoclaving. CHP-pretreated and dyed Nomex ®, as described in WO 89/06292 when printed with the same aqueous print formulation, gave 100% color retention after scouring at the boil with detergent when the dye was fixed by autoclaving. Fixation by saturated steaming at 100° C. and 100% relative humidity (RH) gave color retention in excess of 80%.

A typical process sequence is:

CHP/FR exhaust dye→rinse/dry→aqueous print→dry→autoclave→wash/dry→finish and alternative, abbreviated sequences will suggest themselves.

Printing is conducted at ambient temperatures using conventional printing procedures, after which the fabric is dried followed by heating to fix the dye to the fabric and washed to remove residual CHP. Temperature of fixation depends on the procedure selected; a usual minimum temperature of about 100° C. is observed with temperatures up to 170° C. or higher well tolerated. Appropriate fixation times and temperatures assure acceptable color retention and endurance properties and, when the fabric has been previously dyed and flame retardant treated, retention and durability of the FR properties as measured by phosphorus and/or halogen retention following multiple launderings are excellent. CHP acts as a solvent for a wide variety of flame retardants.

The printing techniques of this invention are useful to print a base shade and/or to overprint a fabric into a full range of shades.

The following examples are offered by illustration and not by way of limitation.

EXAMPLE 1

Printing was conducted using two different thickeners, two different dyes and four different methods of print fixation on three different fabrics. The specifics of these variations were as follows:

Thickeners—A stock thickener solution was prepared containing 25 g of Carbopol 941 and 975 g of water. The Carbopol was dissolved by vigorous stirring with an Eppenbach mixer, followed by neutralization with ammonium hydroxide to pH 7. A second stock solution was prepared by a similar procedure, using Progacyl CP-7, a guar gum, as a thickener.

Print Formulation—A print formulation was prepared using 80% of the stock thickener solution as above, 1% of Telon Blue RRL acid dye, and 19% of water. The viscosity of the print formulation was 7200 cps. A counterpart print formulation was prepared containing 80% of the stock thickener, 15% of CHP, 1% of Telon Blue RRL and 4% of water. The viscosity was reduced by the presence of CHP. Two additional print formulations were prepared as described above, but using Acid Black 132 as the dyestuff.

Printing and Fixing Procedures—The fabrics (all type T-455 Nomex®) were printed by conventional means, dried at 104° C. for 3 minutes, and then fixed by one of the following methods:

1. Saturated steaming at 100° C. and 100% RH for for 5 minutes.
2. High-temperature steaming at 170° C. and 100% RH for 5 minutes
3. Thermosoling for 2.5 minutes at 170° C.
4. Autoclaving, by preheating for one cycle; pre-vacuuming for 7 minutes; steaming at 132° C. for 60 minutes; and post-vacuuming for 7 minutes.

Fabrics—Printing was carried out on two different fabrics, a greige 4.5 oz. Nomex® T-455 fabric of military construction; and the same fabric which had been dyed to the standard military background shade for camouflage fabric according to WO 89/06292. The last (dyed Nomex®) fabric was unwashed after dyeing, and therefore contained residual CHP.

The results of these printing trials are presented in the attached tables, which are designated "% COLOR RETENTION" (Table I) and "COLOR DIFFERENCE-STRENGTH" (Table II). The % Color Retention represents a measure of the color retained by the printed sample after scouring at the boil for two minutes in a solution containing 0.25 g/L of nonionic detergent and 0.25 g/L of sodium carbonate. The % Color Retention represents the percent of the KSSUM value after scouring to the KSSUM value before scouring.

TABLE I

| Sample Identification | | | | % COLOR RETENTION Sat'd. Steam 5 min @ 100° C./100% RH | HT Steam 5 min @ 170° C./100% RH | Thermosol 2.5 min @ 170° C. | Autoclave 60 min @ 270° F. | Line No. |
|---|---|---|---|---|---|---|---|---|
| | | Greige | Control | 4.87 | 5.23 | 4.77 | 31.14 | 1 |
| Thickener: | Dye: | | +CHP | 51.00 | 39.44 | 49.17 | 61.62 | 2 |
| | Telon | | | | | | | |
| Carbopol | Blue | Dyed* | Control | 80.44 | 57.66 | 68.45 | 101.95 | 3 |
| 941 | RRL | | +CHP | 80.20 | 79.41 | 77.13 | 92.98 | 4 |
| | Dye: | Greige | Control | 14.74 | 12.16 | | 42.37 | 5 |
| | Acid | | +CHP | 93.64 | 88.11 | | 85.99 | 6 |
| | Black | | | | | | | |
| Progacyl | 132 | Dyed* | Control | 82.99 | 57.78 | 57.95 | 90.61 | 7 |
| CP-7 | | | +CHP | 95.60 | 80.10 | 83.40 | 97.39 | 8 |
| (Guar Gum) | | | | | | | | |

*Color contribution from substrate.

TABLE II

| Sample Identification | | | | COLOR DIFFERENCE - % STRENGTH Sat'd. Steam 5 min @ 100° C./100% RH | HT Steam 5 min @ 170° C./100% RH | Thermosol 2.5 min @ 170° C. | Autoclave 60 min @ 270° F. | Line No. |
|---|---|---|---|---|---|---|---|---|
| Thickener: | Dye: | Greige | Control | 87.10 w | 86.86 w | 87.68 w | 37.51 w | 1 |
| | Telon | | +CHP | 23.71 w | 45.86 w | 34.42 w | STD | 2 |
| Carbopol | Blue | | | | | | | |
| | RRL | Dyed | Control | 21.89 s | 19.75 w | 25.56 w | 64.72 s | 3 |
| 941 | | | +CHP | 3.65 w | 9.74 w | 13.58 w | STD | 4 |
| Thickener: | Dye: | Greige | Control | 85.82 w | 87.70 w | | 61.04 w | 5 |
| | Acid | | +CHP | 9.16 s | 7.95 w | | STD | 6 |
| CP-7 | Black | | | | | | | |
| | 132 | Dyed | Control | 17.69 w | 20.13 w | 19.72 s | 23.00 s | 7 |
| (Guar Gum) | | | +CHP | 4.56 s | 13.40 w | 16.86 w | STD | 8 |

s = stronger than standard
w = weaker than standard

As shown by the % Color Retention, Table I, the addition of CHP to the print paste greatly increased the color retention of the printed greige Nomex. This was true both for the system thickened with Carbopol 941 containing Telon Blue RRL (lines 1 and 2) and the system thickened with guar gum containing the Acid Black 132 dye (lines 5 and 6). In contrast, addition of CHP produced little effect on the printing of the predyed Nomex fabric when Carbopol was used as the thickener (lines 3 and 4), and only a moderate improvement in the color retention when guar gum was used as thickener (lines 7 and 8).

The results of the color difference measurements, shown in Table II, are in general agreement with the results for % color retention; addition of the CHP to the print paste generally produced a stronger color, particularly in the printed greige fabrics.

It can be concluded that the addition of CHP to the print paste produced satisfactory printing on greige Nomex® fabric, but did little to improve overprinting of dyed Nomex®.

EXAMPLE 2

A 20 gram sample of Type 455 Nomex® was immersed in 400 ml of a dye solution containing:

| | |
|---|---|
| 3.0% o.w.f. | anionic retarding agent, such as Alkanol ND |
| 3.0% o.w.f. | sodium nitrate |
| 60.0 g/l | N-cyclohexyl-2-pyrrolidone |
| 6.0 g/l | Antiblaze 100 |
| 1.0% o.w.f. | formic acid |
| 0.5% | Acid Green 25 |

The fabric was dyed with agitation at 250° F. for 60 minutes, rinsed in cold water and dried at 300° F. The fabric was dyed to a clear blue-green shade to serve as a base shade for further printing.

A print paste was prepared as follows:

| | |
|---|---|
| 6.0% by weight | guar gum, such as Progacyl CP-7 |
| 1.0% by weight | formic acid |
| 50.0 g/l | predissolved Acid Brown 45 |
| q.s. | water as needed to make one liter |

The ingredients were stirred vigorously.

The print paste was applied onto the fabric prepared above through a 60 mesh screen. The fabric was then dried at 375° F. and autoclaved for one hour at 270° F., 30 p.s.i.

After autoclaving, the fabric was scoured in a pressure vessel containing a solution of 1% o.w.f. formic acid at 235° F. for 15 minutes. The fabric was then rinsed cold and dried at 400° F. A clear reddish-brown shade was obtained over-printed on the blue-green base shade.

Other embodiments of the invention in addition to those specifically described and esemplified above will be apparent to one skilled in the art from a consideration of the specification or the practice of the invention disclosed herein. It is intended that the specification and examples be considered as exemplary only, with the true scope and spirit of the invention being indicated by the claims that follow.

Another embodiment of our invention provides an effective, less-costly procedure to fix dyes or flame retardants or both in aramid fibers without the use of extended heat treatments and energy-intensive, costly finishing equipment such as autoclaving. This procedure employs atmospheric steaming with saturated steam at 100° C. to fix the dye and/or flame retardant in the fiber structure. Fixation of the dye is sufficient to provide excellent color retention often reaching 80% or better particularly with acid and cationic dyes. This atmospheric steaming procedure is suited to Nomex-type fabrics dyed and/or flame retardant treated with CHP, as described above. Atmospheric steaming as disclosed herein provides an effective, time, equipment and cost-saving procedure to fix dyes and/or flame retardants to Nomex-type aramid fibers.

Printing was conducted on a 4.5 oz/sq. yd. Nomex T-455 fabric, which had been pretreated with CHP to facilitate subsequent printing. Three different dyes and two different thickeners were used to prepare print pastes, and several different methods of print fixation were employed. The specifics of these variations were as follows:

Pretreatment Procedure—The following examples illustrate procedures for printing Nomex-type aramid fabrics by fixing the dyestuff to the fiber with atmospheric steam. The carrier may be applied to the fabric prior ro printing, for instance when applying a background shade, as described below, or in the print paste, or both. The background shade was applied by an exhaust process conducted in the temperature range of about 93° C. to 130° C., normally 130° C. In these experiments the bath contained a dyestuff (Acid Blue 113, Acid Green 106, or Basic Blue 77), from 50 to 100 g/liter of CHP, and optionally 6 g/liter of Antiblaze 100 flame retardant. After heating was completed, the dyed, or dyed and flame retarded fabric was cooled, rinsed in cold tap water, and air dried.

Print Paste Formulation—Two stock thickeners were prepared for making printing pastes. The first contained 3% of Carbopol 820 solids, with the remainder water. The second thickener contained 3% of Carbopol, plus from 50 to 100 g/liter of CHP. A suitable quantity of dye, normally 1% based on the weight of solution, was also present. The viscosity of the print paste was approximately 15,000 cps.

Printing Procedure—After printing using the thus-prepared print paste applied by conventional means, the fabrics were dried at 104° C. for 3 minutes, and then fixed in saturated steam or superheated steam in a Mathis high-temperature steamer. Saturated steam (100° C., to 100% relative humidity) and superheated steam at 130° C., to 150° C., and 190° C. were evaluated for times of 5, 15, 30 or 60 minutes. Satisfactory results were obtained under all of these conditions. Best results were obtained in saturated steam at 100° C. for 15, 30 or 60 minutes. A time of 15 minutes was adequate to produce optimum color.

The printed fabrics were rinsed thoroughly and then dried.

EXAMPLE 3

In this example, printing was performed on fabric pretreated with 60 g/liter of CHP. The dye was Acid Blue 113, and the Color Retention was 84.8%. Pretreatment (dyeing to provide background shade) was performed at 130° C. for one hour in a bath not containing the flame retardant Antiblaze 100; when flame retardant was present, the Color Retention was similar, and the Limiting Oxygen Index was 35% or higher.

Print fixation was carried out in saturated steam at 100° C. for 15 minutes.

The fixed fabric showed excellent fixation of color, as shown by its deep blue color. This result shows that satisfactory printing of Nomex can be obtained by fixation in saturated steam, obviating the need for autoclaving.

EXAMPLE 4

An experiment was performed as in Example 3, but using Basic Blue 77 as the dye, and fixing in saturated steam for 15 minutes. Fixation of color was excellent, and the color retention was 90.3%.

EXAMPLE 5

An experiment was performed as in Example 4, except that the time of saturated steaming was 30 minutes. The color retention was 91.7%.

EXAMPLE 6

An example was performed as in Example 3, except that the print paste contained no dye diffusion promotion agent. The color retention of this water control was 53.3%.

What is claimed is:

1. A process of dyeing a poly(m-phenyleneisophthalamide) textile fabric comprising the successive steps of:

(a) supplying a poly(m-phenyleneiosphthalamide) textile fabric having a dye-enhancing amount of N-cyclohexyl-2-pyrrolidone thereon;

(b) applying a tinctorial amount of at least one dyestuff to the fabric and then (c) drying, then steaming the thus-treated fabric with saturated steam or superheated steam at an elevated temperature of at least about 100° C. for a time sufficient to permeate and fix the dyestuff inside the poly(m-phenyleneisophthalamide) fibers.

2. The process of claim 1, in which the fabric of step (a) contains up to 50% by weight N-cyclohexyl-2-pyrrolidone.

3. The process of claim 1, in which, prior to step (a), N-cyclohexyl-2-pyrrolidone is applied to the fabric.

4. The process of claim 1, including the additional step of (d) removing residual N-cyclohexyl-2-pyrrolidone remaining on the fabric.

5. The process of claim 1, in which the fabric is composed of poly (m-phenyleneisophthalamide) blended with up to 50% of other fibers.

6. The process of claim 5, in which the fibers blended with the poly(m-phenyleneisophthalamide) are at least one of poly(p-phenyleneterephthalamide), polybenzimidazole, flame-resistant cotton, flame-resistant rayon, nylon, wool or modacrylic fibers.

7. The process of claim 1, in which the fabric consists entirely of poly(m-phenyleneisophthalamide).

8. The process of claim 1, in which at least one of a flame retardant, an ultra-violet light absorber, an antistatic agent, or a water repellent is also applied to the fabric in step (b).

9. A process of printing a predetermined pattern on a poly(m-phenyleneisophthalamide) textile fabric comprising the successive steps of:

(a) supplying a poly(m-phenyleneisophthalamide) textile fabric having a dye-enhancing amount of N-cyclohexyl-2-pyrrolidone thereon;

(b) applying onto the fabric a print paste consisting essentially of a tinctorial amount of at least one dyestuff, a print paste thickening agent, and water, in a predetermined pattern; and then (c) drying, then steaming the thus-treated fabric with saturated steam or superheated steam at an elevated temperature of at least about 100° C. for a time sufficient to permeate and fix the dyestuff inside the poly(m-phenyleneisophthalamide) fibers.

10. The process of claim 9, in which the fabric of step (a) contains up to 50% by weight N-cyclohexyl-2-pyrrolidone.

11. The process of claim 9, in which, prior to step (a) N-cyclohexyl-2-pyrrolidone is applied to the fabric.

12. The process of claim 9, in which the fabric of step (a) has been dyed to a predetermined base shade using N-cyclohexyl-2-pyrrolidone as the dye diffusion promoter and also contains a flame retardant thereon.

13. The process of claim 9, including the additional step of (d) removing residual N-cyclohexyl-2-pyrrolidone remaining on the fabric.

14. The process of claim 9 in which the fabric is composed of poly(m-phenyleneisophthalamide) blended with up to 50% of other fibers.

15. The process of claim 14, in which the fibers blended with the poly(m-phenyleneisophthalamide) are at least one of poly(p-phenyleneterephthalamide), polybenzimidazole, flame-resistant cotton, flame-resistant rayon, nylon, wool or modacrylic fibers.

16. The process of claim 9, in which the fabric consists entirely of poly(m-phenylene isophthalamide).

17. The process of claim 9, in which the print paste additionally contains at least one of a flame retardant, an ultra-violet light absorber, an antistatic agent, or a water repellent.

18. A process of printing a predetermined pattern on a textile fabric composed of poly(m-phenyleneisophthalamide) comprising the steps of:

(a) applying onto a poly(m-phenyleneisophthalamide)-containing fabric in a predetermined pattern a print paste consisting essentially of a dye facilitating amount of N-cyclohexyl-2-pyrrolidone sufficient to dye the poly(m-phenyleneisophthalamide) fibers of the fabric, at least one dyestuff compatible with N-cyclohexyl-2-pyrrolidone, a print paste thickener compatible with N-cyclohexyl-2-pyrrolidone, and water and, thereafter, (b) drying and curing the thus treated fabric at an elevated temperature of about 100° C. to about 210° C. and for a time sufficient to permeate and fix the dyestuff inside the poly(m-phenyleneisophthalamide) fibers.

19. A print paste for printing and dyeing poly(m-phenyleneisophthalamide) textile fabric in a predetermined pattern, the print paste consisting essentially, in percent by weight, of:

about 5 to about 50 parts of N-cyclohexyl-2-pyrrolidone as a diffusion promoter and swelling agent to introduce a compatible dyestuff into the poly(m-phenyleneisophthalamide) fibers;

a tinctorial amount of at least one organic dyestuff soluble in an aqueous solution of N-cyclohexyl-2-pyrrolidone and capable of dyeing and fixing in the fibers;

a print paste thickener soluble in an aqueous solution of N-cyclohexyl-2-pyrrolidone and compatible with the other ingredients of the print paste, the thickener present in an amount sufficient to provide printing viscosity, balance water.

20. The print paste of claim 19, in which the dyestuff is an acid, basic, mordant, direct, metalized, disperse or reactive dye.

21. A process for pretreating poly(m-phenyleneisophthalamide) fibers or fabric comprising applying to said fiber or fabric a dye-enhancing or flame-retardant enhancing amount of N-cyclohexyl-2-pyrrolidone.

22. The process of claim 21, in which the poly(m-phenyleneisophthalamide) fibers or fabric contain up to 50% by weight of N-cyclohexyl-2-pyrrolidone.

23. The process of claim 22, in which the poly(m-phenyleneisophthalamide) fibers or fabric contain from 5% to 15% by weight of N-cyclohexyl-2-pyrrolidone.

24. Poly(m-phenyleneisophthalamide) fibers or fabric having from 5% to 15% by weight of N-cyclohexyl-2-pyrrolidone to make the fibers or fabric receptive to dyeing, printing or flame retardant treating.

25. The process of claim 18, in which step (b) is conducted in saturated steam at about 100° C.

* * * * *